US008957007B2

(12) United States Patent
Moorre

(10) Patent No.: US 8,957,007 B2
(45) Date of Patent: Feb. 17, 2015

(54) ALUMINUM SAFE COMPOSITIONS FOR REMOVING CURED POLYSULFIDE RESINS

(76) Inventor: John Cleaon Moorre, Camarillo, CA (US)

( * ) Notice: Subject to any disclaimer, the term of this patent is extended or adjusted under 35 U.S.C. 154(b) by 126 days.

(21) Appl. No.: 13/586,108

(22) Filed: Aug. 15, 2012

(65) Prior Publication Data

US 2013/0206166 A1 Aug. 15, 2013

Related U.S. Application Data

(60) Provisional application No. 61/524,321, filed on Aug. 17, 2011.

(51) Int. Cl.

| | |
|---|---|
| ***C11D 7/50*** | (2006.01) |
| ***C23G 1/22*** | (2006.01) |
| ***C23G 5/036*** | (2006.01) |
| ***C23G 5/06*** | (2006.01) |

(52) U.S. Cl.

CPC *C23G 1/22* (2013.01); *C23G 5/036* (2013.01); *C23G 5/06* (2013.01)

USPC ..... 510/201; 510/202; 510/212

(58) Field of Classification Search

CPC ..... C11D 3/43; C11D 7/266; C11D 3/3947

USPC ..... 510/201, 202, 212

See application file for complete search history.

(56) References Cited

U.S. PATENT DOCUMENTS

| | | | | |
|---|---|---|---|---|
| 6,187,108 | B1 * | 2/2001 | Machac et al. | 134/38 |
| 7,005,409 | B2 | 2/2006 | Moore | |
| 2002/0111284 | A1 * | 8/2002 | Machac et al. | 510/245 |
| 2004/0038840 | A1 * | 2/2004 | Lee et al. | 510/202 |
| 2005/0192194 | A1 * | 9/2005 | Esposito et al. | 510/188 |
| 2013/0123411 | A1 * | 5/2013 | Quillen et al. | 524/377 |
| 2013/0261039 | A1 * | 10/2013 | Little | 510/175 |
| 2013/0330927 | A1 * | 12/2013 | Kumagai et al. | 438/675 |

OTHER PUBLICATIONS

American Society for Testing and Materials (ASTM) F1110-09 Standard Test Method for Sandwich Corrosion Test.

* cited by examiner

*Primary Examiner* — Gregory Webb
(74) *Attorney, Agent, or Firm* — Andrew Auerbach

(57) ABSTRACT

A metal-safe dissolving composition for cured resins, comprising a solvent blend that includes a metal safe solvent mixture with addition of a soluble alkali that exhibits a pKa value ≥12. The solvent mixture may include the preferred solvent for metal safety, gamma-butyrolactone (GBL), and the preferred soluble amine, 1,8-diazabicyclo(5.4.0)undec-7-ene (DBU). The solvent, n,n-dimethylacetamide (DMAC) or others, are chosen for high penetration and solvency to polar resins. To this mixture, a surfactant, inhibitor, and cellulose derivative may be added to produce a gel-form property. The product may be used to remove coatings and sealants present on vertical and horizontal surfaces and hard to reach areas commonly encountered when performing maintenance on aviation fuel tanks and similar equipment. Of key importance for the remover is its safety to aluminum and aluminum alloy substrates as demonstrated by modified test methods for sandwich corrosion, for example, ASTM F1110.

13 Claims, No Drawings

ALUMINUM SAFE COMPOSITIONS FOR REMOVING CURED POLYSULFIDE RESINS

CROSS-REFERENCE TO RELATED APPLICATION

This application claims the benefit of U.S. Provisional Application No. 61/524,321 filed Aug. 17, 2011.

This invention relates to compositions exhibiting aluminum and aluminum alloy safety in liquid for immersion or spray contact and a gel-form that is suitable for application on vertical and overhead surfaces, collectively, these have been shown to effectively revert and dissolve cured polymeric compositions, and in particular, polysulfide substances contained on said surfaces.

BACKGROUND OF THE INVENTION

Polysulfide-based resins are used widely in the protection and sealing of components and hardware comprising aluminum and aluminum alloys and also in providing sealing of enclosures containing a range of hydrocarbon-based fuels. In fact, polysulfide-based resins are the primary products of choice for sealing fuel tank compartments manufactured from aluminum and aluminum alloys. The aviation and automotive markets require fuel tank sealants, and are highly regulated by the federal government to provide specific performance qualities. These polysulfide sealant formulations have been held constant over many decades. The sealants are used in many aircraft, from small recreational, to commercial airlines, including the military.

When it becomes necessary to perform repair and maintenance on the polysulfide sealant, it is most common to begin the process with complete removal of the material from the area in question. Removal of the sealant typically includes scraping and mechanical abrasion, resulting in significant damage to the underlying substrate, typically composed of aluminum and aluminum alloys and many times are protected by chemical passivation or coated by cured epoxy. When substrate damage occurs, as is commonly the case with mechanical removal of the polysulfide sealant, the surfaces must be reconditioned, requiring the use of several steps that mechanically polish and chemically passivate the aluminum or aluminum alloy. Once the metal is passivated, there are further steps to prime the surface and coat with a cured epoxy resin. These process steps, each with a separate inspection, require an accumulation of time that can add hours onto a sealant integrity test within a defined area.

Alternatively, substrate damage by mechanical removal of polysulfide sealant may be avoided by the use of solvent mixtures through immersion or spray operations. When liquids are difficult or impossible to control their flow into select areas or dripping and spreading from vertical and overhead structures, the option exists to convert the liquid to a gel-form. Compositions of liquid and gel-form types of polysulfide removal are described in U.S. Pat. No. 7,005,409 (Dissolving Gel for Cured Polysulfide Resins, 2006), Moore et. al. The reacted polysulfide species in these forms may be washed away instead of wiping with a rag or napkin. Rinses include alcohol or water, which emulsify and disperse the reacted species and rapidly remove it from the surface, orifices, and cracks thereof, whereby continued rinsing will allow the substrate to be left clean.

Due to the aggressive nature of the liquid and gel-forms of the polysulfide sealant remover, it is also a common observance of the chemistry to attack certain metals by means of oxidation, corrosion, and the like, most specifically to aluminum metal and alloys thereof. When these liquid and gel-form cleaners are observed to attack the substrate, additional hours of corrective action must occur with a follow-on sealant integrity test. In such occurrences, the benefits of using a liquid or gel-form cleaner may be lost by the additional practices of correcting substrate damage. It is the object of this invention to provide compositions of matter, which are metal safe, and methods, which effectively and efficiently remove, cured polysulfide sealant.

Maintenance on underground storage tanks and aircraft must be performed regularly. In such cases, leak tests and other integrity screens are conducted. When it becomes necessary to undertake work to correct a problem, the tank or aircraft must be removed from service. This removal time imparts significant costs onto the system depending upon its service. For an underground tank, the business must close off this area from use for a period of time necessary to complete work. In the case of a service station and depending upon the extent of work, the business may have to completely close down in order to protect public safety. Following work completion, the tank may continue to be out of service until inspected and certified by government officials. Costs may approach double-digit percentages of the annual revenue for that service station.

In the case of an aircraft, polysulfide sealant inspection and maintenance may represent a scheduled review, which cause other active aircraft to be shuffled around to take its place. Engineers must schedule service at special locations suitable for such work and, depending upon the severity of the condition, a time estimate is assigned for completion, inspection, and certification of the work. In the case of certain airlines that contain a fleet of several hundred aircraft, this sort of timing may represent several days out of service, but be measured by the hour. What are worrisome are the delays, which occasionally occur due to multi-step polysulfide removal. An aircraft that misses its reactivation into the fleet will immediately force other active aircraft to be shuffled around to provide coverage for missed locations. This activity causes a far-reaching burden to the airline fleet and soaring costs, usually several factors multiplied by the price of the original service. For this reason and several others, a metal-safe chemistry is needed to remove polysulfide sealant in a manner that is mechanically and chemically safe for the substrate.

As a consequence of the needs for an effective and practical dissolution mechanism for polysulfide resin while exhibiting substrate metal safety, the composition of the present invention was developed and found to be effective. The metal-safe liquid penetrates and flows around the subject to be cleaned while the gel adheres well and allows the chemical formulation to be in direct contact with the cured polysulfide resin present on vertical and overhead surfaces. As polysulfide is reacted, it is dispersed to the bulk mixture, leaving underlying new resin to be exposed, reacted, and subsequently removed by the liquid. This cycle continues until all material is reacted and dispersed within the remover chemistry until the substrate is the last surface to be exposed to the liquid and occurs without any observed effects or damage. The process also occurs within the gel-form of a metal safe polysulfide remover. The process is accelerated by periodic removal by wiping of reacted chemistry and reapplying with fresh removal gel, until the substrate is exposed and protected using the metal safe invention.

The invention composition protects the substrate metal without sacrifice to the removal performance of polysulfide sealant using the form of a liquid or a gel. Although it is well known that inhibitors for corrosion or damage control may be simply added to formulations, this practice commonly results in a reduction in removal performance. Namely, the inhibitor not only inhibits corrosion to the substrate, however, it will affect the active ingredients in a way to reduce performance. This invention does not consider these simple approaches. Instead, the invention composition was designed in a manner to maintain high performance in removing polysulfide in both liquid and gel forms of the product.

SUMMARY OF INVENTION

It has now been discovered, according to the invention, that a composition comprising a blend of chemistries which may include a viscosity modifier (gelling agent) is designed to revert, i.e. breakdown, and dissolve fully cross-linked (cured) polysulfide resins without affecting the integrity of the underlying metal substrate. Such polymers include various sulfide-containing polymers consisting primarily of cross-linked poly-dithioethylenes, -tetrathioethylenes, -thiobiphenylenes, -thiodifluoromethylenes, and -thiophenylenes and other related compounds containing the "thio" linkage identified as $[—C—S—C—]_n$, where "n" identifies the number of unit occurrences of this linkage.

When the cross-linked polysulfide is exposed to the composition of the invention, the polymer will begin to breakdown, allowing the residue to be easily wiped or rinsed away without mechanical and chemical damage to the underlying aluminum and aluminum alloy substrate. Applications and use of compositions of the invention include the removal of polysulfide encapsulation in electronics, sealants in aircraft, coatings and sealants in fuel tanks (e.g. underground storage tanks), and other uses where elimination of insoluble cross-linked (cured) polysulfide polymer is desired. Included in the invention is the ability to prepare the product in forms of a liquid or gel, allowing opportunities to remove polysulfide resin from small parts by immersion and from open areas where liquids would flow to unwanted areas, including vertical and overhead surfaces.

Of particular importance in the invention is the aspect of metal safety, and specifically to aluminum and aluminum alloys. Due to the highly regulated condition of materials and workmanship in areas where polysulfide is used, for example, electronics, aviation, aerospace, and petroleum (fuel) storage and distribution, many meticulous steps must be used to install polysulfide resin. Substrate preparation is critical to protect the hard surface and ensure satisfactory adhesion of the sealant. Materials must be applied and inspected with a high level of redundancy. To this end, test methods exist to ensure that materials and practices agree with the proper care and assurance of performance. At the time of this invention development, the list of test curricula that applies to the use and application of polysulfide cleaners includes: American Society for Testing and Materials (ASTM) F1110 (Sandwich Corrosion), ASTM F519 (Hydrogen Embrittlement), ASTM F502 (Effects on Painted Surfaces), and ASTM F484 (Total Immersion Corrosion). The invention has been tested against these criteria and approved. The invention is superior in metal safety over the prior art as specified in U.S. Pat. No. 7,005,409 (Dissolving Gel for Cured Polysulfide Resins, 2006), Moore et. al, which has been shown to attack metals and does not pass the test criteria for the ASTM.

This invention may be applied by many means including direct liquid contact by immersion, spray, or gel-form by pallet knife, paint-type roller, pump, sealant-type gun, or simply the use of wipes and rubber gloves. Once applied, the removal rates of the invention are satisfactory as compared to existing products on the market, such as the material identified in U.S. Pat. No. 7,005,409 (Dissolving Gel for Cured Polysulfide Resins, 2006), Moore et. al. The exact rate of dissolution of any given cured polysulfide will depend upon the formulation of the polysulfide, i.e., fillers contained, and amount, i.e. thickness present, and on conditions of the removal practice. Heat and agitation may be used to improve the removal process without effect to the integrity of the underlying metal substrate.

DETAILED DESCRIPTION OF THE INVENTION

It is an object of this invention to provide a metal-safe composition of matter that operates as a chemical remover (dissolving system) of cured polysulfide resins by methods that include bringing into direct contact the invention with the resin and allowing it maintain contact for a period of time satisfactory to achieve the desired removal performance, and upon rinsing or wiping the invention mixture comprising reacted polysulfide resin away from the underlying substrate, it is observed that the metal integrity is preserved. This object and other objects which will become apparent from the description which follows, are achieved by the metal-safe composition of the invention which comprise a mixture of:

(a) one or more members from the groups consisting of polar organic solvents, including alcohols, amides, esters, ethers, glycol ether esters, glycol ethers, glycols, ketones, lactates, sulfoxides; and, (b) one or more members from the groups consisting of organic alkalis, amines, solvent soluble hydroxides; and, (c) one or more corrosion inhibitors providing sufficient substrate protection without reducing performance; wherein, the components a-c are present at sufficient concentrations, which when mixed together, will produce a system that enables the metal safe removal of cured polysulfide resins; such a mixture of components would contain item (a) present in the amount of about 0.1 to about 99 wt %, component (b) present in an amount of about 0.5 to about 99.5 wt %, and component (c) present in an amount of about 0.01 to about 25 wt %. The composition is mixed to produce a uniform system, which operates as a chemical remover for cured polysulfide resins with metal safety achieved during the time period of its performance, whereby upon removal using conventional rinsing or wiping processes, a protected substrate free of polysulfide resin is achieved.

The components identified in the aforementioned categories a-c are present in a system and include preferred species known to provide certain performance values of interest in cleaning practices in manufacturing. These preferred items identified in the listed categories include the following:

(a) suitable solvents include, but are not limited to ketones such as cyclohexanone, 2-heptanone, methyl propyl ketone, and methyl amyl ketone, esters such as isopropyl acetate, ethyl acetate, butyl acetate, ethyl propionate, methyl propionate, ethyl 2-hydroxypropionate(ethyl lactate (EL)), ethyl 2-hydroxy-2-methyl propionate, ethyl hydroxyacetate, ethyl 2-hydroxy-3-methyl butanoate, methyl 3-methoxypropionate, ethyl 3-methoxy propionate, ethyl 3-ethoxypropionate, methyl 3-ethoxy propionate, methyl pyruvate, and ethyl pyruvate, ethers and glycol ethers such as diisopropyl ether, ethyleneglycol monomethyl ether, ethyleneglycol monoethyl ether, diethylene glycol monoethyl ether and propylene glycol monomethyl ether (PGME), 3-methoxy-3-methyl-1-butanol (MMB), glycol ether esters such as ethyleneglycol monoethyl ether acetate, propyleneglycol methyl ether acetate (PGMEA), and propyleneglycol propyl ether acetate, aromatic solvents such as methylbenzene, dimethylbenzene, anisole, and nitrobenzene, amide solvents such as N,N-dimethylacetamide (DMAC), N,N-dimethylformamide, and N-methylformanilide, and pyrrolidones such as N-methylpyrrolidone (NMP), N-ethylpyrrolidone (NEP), dimethylpiperidone, 2-pyrrole, N-hydroxyethyl-2-pyrrolidone (HEP), N-cyclohexyl-2-pyrrolidone (CHP), sulfur containing solvents such as dimethyl sulfoxide, dimethyl sulfone and tetramethylene sulfone, and preferred of the solvents include gamma-butyrolactone (GBL or BLO);

(b) alkali or base of organic or inorganic origin to include ammonium hydroxide, quaternary hydroxides, amines, alkanolamines, elemental hydroxides, or alkoxides, and preferred of the alkalis include 1,8-diazabicyclo(5.4.0)undec-7-ene (DBU);

(c) inhibitors defined as a protecting agents to include chelating and complexing agents, including benzylic hydroxides such as catechol, triazoles such as benzotriazole (BTA) and tolyltriazole (TTA), alkyl-sulfonic acids, phosphoric acids and phosphoric acid esters; imidazoles, imidazolines, borates, phosphates, and alkyl or elemental silicates, ethylenediaminetetraacetic acid, diethylenetriaminepentaacetic acid, nitrilotriacetic acid, and 2,4-pentanedione, reducing sugars, hydroquinones, glyoxal, salicylaldehyde, fatty acids such as citric and ascorbic acid, hydroxylamines, silicates as alkali-element salts, organosilicates as tetraethylorthosilicate (TEOS), monomeric and oligomeric condensates of organosilicates, monomeric siloxane derivatives, alkyalkoxysilanes, or vanillin.

When a cellulosic-based polymerization additive is used in the preparation of the mixture, the result is a gel form of the final product that is stable over long periods of time. This gel-form solvent system allows its application to vertical and overhead surfaces with a high selectivity. Once the solvent system is brought into contact with the polysulfide resin, the amine component extracts the sulfide and breaks down the resin where it may be easily wiped away from the surface, leaving the underlying substrate unharmed. In situations where wiping with a rag or napkin is not possible or impractical, rinsing with alcohol or water may be performed. The rinse mixes with the gel and reacted polysulfide to emulsify and disperse it from the substrate, leaving small cracks and hard to reach crevices free of residue.

The primary objective of the present invention is to provide a liquid or gel form of the cured polysulfide remover that does not harm aluminum or aluminum alloy substrates. The formulation protects the substrate by providing a safe medium to the substrate while maintaining aggressive removal of the resin. The system must be free of water (e.g. anhydrous) in order for it to penetrate and swell the cured resin. The preferred solvent, gamma-butyrolactone (GBL or BLO) is used for effective protection of the substrate and solubility on the resin, while the preferred amine, 1,8-diazabicyclo(5.4.0)undec-7-ene (DBU), is present to leach-out the sulfide chemistry and react to effect complete dissolution. Although the BLO solvent acts to protect aluminum and aluminum alloy substrates, other inhibitors may be added, including the preferred tetraethylorthosilicate (TEOS). A co-solvent, which may be chosen from a variety of chemistries, such as N,N-dimethylacetamide (DMAC), N-methylpyrrolidone (NMP), or dimethyl sulfoxide (DMSO) is present to enhance the resin dissociation. Co-solvency of the mixture that provides properties which exceeds the individual components is achieved through a range of concentrations from equal parts (1:1) to a ratio of 20:1. This phenomenon is explained by molecular desegregation brought about by the mixtures.

Suitable surfactants include non-ionic alkoxylated linear alcohols and specifically those which exhibit cloud points >45 degrees C. The surfactant functions to reduce surface tension and aid in the rinsing process. A non-ionic environment is required for inert conditions towards dissolved metals and maximum solubility in a wide range of media, both solvent and water. Low foaming capacity allows for product use in various automated equipment. Alternative surfactants include nonyl-phenols and nonyl-ethoxylates with a HLB (hydrophilic/lipophilic balance) ranging from 7-15. Less than about 2 weight percent of the non-ionic surfactant and preferable an amount of about 0.5 to about 1 weight percent is sufficient.

EXPERIMENTAL

Experiment 1

Modified ASTM F1110 (Sandwich Corrosion Test)

The following describes a method for determining aluminum and aluminum alloy corrosion by a modified ASTM method. The method describes a simple approach to estimating corrosion within 5 hrs and overnight (~15 hrs). The following test is conducted for 4 specimens (samples). In each case, two (2) pieces of aluminum are required.

1. Acquire 8 pieces of aluminum coupons of approximate size 2"×3" (L×W) and thickness of 0.1" or greater. Clean with water using a sponge. Do not use detergent or any chemistry that would leave residue. Air dry.
2. Cut a paper towel ¾"×3¾" and place on top of a clean aluminum coupon.
3. Wet the paper towel with 1 ml of the solution to be tested.
4. Cover with $2^{nd}$ aluminum coupon to form a sandwich and tape the edges closed with 1" clear tape. This will effectively minimize evaporation.
5. Repeat steps 2 to 4 for the remaining solutions to be tested.
6. Place the coupons lying flat (horizontally) in a "humidity" container.
7. Pour a 50-ml beaker with 30 ml water. Place the beaker at the corner of the humidity container.
8. Place the container inside the oven at 35 to 40 C.
9. After 5 hours, remove from oven and observe the aluminum coupons for the presence of corrosion. Corrosion is observed by a darkening of the aluminum surface as evidenced by stains or discoloration. Aluminum is normally a bright metallic color without discoloration.
10. If paper towel has dried, wet with the solution being tested. Sandwich with a coupon and seal edges with tape.
11. Return to the oven and observe after overnight period.

TABLE 1.1

Test of modified ASTM F1110 with various sample liquids on aluminum.

| No. | Material | Observation 5 Hours | Observation Overnight |
|---|---|---|---|
| 1 | Deionized Water | Discoloration | Corrosion |
| 2 | DMAC:DBU 95:5 | Discoloration | Corrosion |
| 3 | DMAC:DBU 90:10 | No change | Corrosion |
| 4 | DMAC:DBU 75:25 | No change | Corrosion |

DMAC: N,N-dimethylacetamide (DMAC),
DBU: 1,8-diazabicyclo(5.4.0)undec-7-ene

Results of Experiment #1 demonstrate a method to test for sandwich corrosion on aluminum and aluminum alloy following a modified ASTM F1110 method. In this case, all mixtures of DBU and DMAC solvent failed the method. U.S. Pat. No. 7,005,409 is represented by chemistries #2-4, failure of ASTM F1110.

Experiment 2

Corrosion Inhibitors and Modified ASTM F1110

The following describes testing of inhibitor additives to polysulfide cleaner chemistry. The mixture is applied to aluminum samples in the same manner as described in experiment #1 within this invention document. The stock polysulfide remover solution tested in this experiment contains: N,N-dimethylacetamide (DMAC) and 1,8-diazabicyclo(5.4.0)undec-7-ene (DBU) as DMAC:DBU 95:5. The inhibitor is described as the item and amount added to the stock polysulfide remover.

TABLE 2.1

Inhibitor description.

| Trade Name | Chemical Name | Manufacturer |
|---|---|---|
| Silicate TES28 | Tetraethyl Orthosilicate | Wacker Chemical Corp. |
| Silicate TES40 | Tetraethyl Orthosilicate | Wacker Chemical Corp. |
| Silbond 40HF | Alkyl Silicate | Silbond Corporation |
| Silbond Condensed | Ethyl Silicate | Silbond Corporation |
| Dynasylan 1189 | N-(n-Butyl)-3-amino-propyltrimethoxysilane | Evonik Degussa Corp. |

TABLE 2.2

Results of sandwich corrosion testing on stock polysulfide remover with inhibitor additions as stated. Twenty percent (20%) DIW was added to each mixture to accelerate corrosion, modified ASTM F1110. Inhibitors are described in Table 2.1.

| No. | Additive | Results |
|---|---|---|
| BH | None | Corrosion |
| B1H | None | Corrosion |
| A4H | 4% TES 28 | Corrosion |
| B4H | 4% TES 40 | Minimal Corrosion |
| C4H | 4% Silbond 40HF | Minimal Corrosion |
| D4H | 4% Silbond Condensed | Corrosion |
| E4H | 4% Dynasylan 1189 | Corrosion |
| A6H | 6% TES 28 | Minimal Corrosion |
| B6H | 6% TES 40 | Corrosion |
| C6H | 6% Silbond 40HF | Minimal Corrosion |
| D6H | 6% Silbond Condensed | Corrosion |
| E6H | 6% Dynasylan 1189 | Minimal Corrosion |

Note:
All solutions use stock polysulfide remover: N,N-dimethylacetamide (DMAC) and 1,8-diazabicyclo(5.4.0)undec-7-ene (DBU) as DMAC:DBU 95:5.

Results of Experiment #2 demonstrate the benefits of inhibitor additive for testing sandwich corrosion on aluminum and aluminum alloy following a modified ASTM F1110 method. In this case, several silicate additives improved metal safety.

Experiment 3

Corrosion Inhibitors and Modified ASTM F1110

The following tests present the testing of inhibitors with solvent adjustment (changing solvent media). All media contain amine as 1,8-diazabicyclo(5.4.0)undec-7-ene (DBU) added to the mixture as ~5%, as solvent:DBU 95:5 Inhibitor tested in silane-based Dynasylan 1189 used at 6% in the system, described in Table 2.1.

TABLE 3.1

Solutions tested for corrosion.

| No. | Solvent | Inhibitor | Results |
|---|---|---|---|
| B1A | DMAC | None | Corrosion |
| B2A | DMAC | None | Corrosion |
| B1B | DMAC | Dynasylan 1189 | Corrosion |
| 1A | DMAC + H2O | None | Corrosion |
| 2A | DMSO + H2O | None | Corrosion |
| 3A | BLO + H2O | None | Clean |
| 7A | NEP + H2O | None | Corrosion |
| 1B | DMAC + H2O | Dynasylan 1189 | Corrosion |
| 2B | DMSO + H2O | Dynasylan 1189 | Corrosion |
| 3B | BLO + H2O | Dynasylan 1189 | Clean |
| 7B | NEP + H2O | Dynasylan 1189 | Corrosion |

DMAC: N,N-dimethylacetamide,
BLO: gamma-butyrolactone,
NEP: N-ethylpyrrolidone,
DMSO: dimethylsulfoxide.

TABLE 3.2

Follow-on additional testing using solvent and inhibitor.

| No. | Solvent | Inhibitor | Results |
|---|---|---|---|
| B | DMAC + H2O | None | Corrosion |
| B1 | DMAC + H2O | None | Corrosion |
| 1A | DMAC + H2O | None | Corrosion |
| 3A | BLO + H2O | None | Clean |
| 7A | NEP + H2O | None | Corrosion |
| 11A | DMAC + H2O | Dynasylan 1189 | Corrosion |
| 1&3A | Solution 1A + 3A | None | Clean |
| 3&7A | Solution 3A + 7A | None | Clean |

Results of Experiment #3 demonstrate the effects of the solvent to provide inhibitor character during sandwich corrosion on aluminum and aluminum alloy following a modified ASTM F1110 method. In this case, the use of the solvent, BLO, offered improved metal safety.

Experiment 4

Polysulfide Removal Performance and Modified ASTM F1110 for Corrosion

The following tests focus on the performance of cured polysulfide resin removal and follow-on tests for corrosion using a modified ASTM F1110 method. The method for removal performance is described as follows using glass vials containing a specific amount of removal chemistry in direct contact with an aluminum specimen with a standard amount of polysulfide resin cured upon its surface.

1. Acquire a standard aluminum coupon with cured polysulfide, weigh this prior to beginning experiment.
2. To a standard 40 ml size tall clear glass vial, acquire polysulfide removal chemistry to be tested and weigh 38 grams of the fluid into the glass vial.
3. Using a timer, insert the standard cut coupon with specific amount of cured polysulfide onto its surface and begin the timer. The polysulfide should be completely immersed within the fluid.
4. At each increment of 1 hour, the coupon is removed from the liquid, blotted with a nonwoven cellulose towel, or equivalent, and weighed.
5. Continue the test until the sealant is completely removed all the way down to metal. This is represented when the paper towel cleaning does not leave any remaining resin upon the aluminum surface. The weight is measured.

6. The weight and time from one hour earlier is used as the final number.
7. The coupon is returned to the solution for an extended time to ensure any small dots or residues of resin are removed. This is to ensure a clean aluminum part is used for the calculation of % removal. At the end of an extended time, remove the aluminum part, wipe clean and dry, weigh.
8. Percent removal, i.e. polysulfide that dissolved in the solution, is calculated using the following formula:

$$\% \text{ Removal}=[1-((P-A/T-A))]\times 100$$

where:

P=weight of last measure (i.e. #6)

T=total weight of aluminum and PS (i.e. #1)

A=weight of aluminum only (i.e. #7)

TABLE 4.1

Composition of solutions tested.

| No. | DMAC | BLO | DBU | % Removal | Corrosion |
|---|---|---|---|---|---|
| B1 | 95 | 0 | 5 | 69.15 | Yes |
| 1 | 55 | 40 | 5 | 62.84 | No |
| 1A | 70 | 25 | 5 | 67.06 | No |
| 1B | 70 | 20 | 10 | 70.92 | No |

Results of experiment #4 demonstrate the performance of polysulfide removal and the solution inhibiting effects during sandwich corrosion on aluminum and aluminum alloy following a modified ASTM F1110 method. In this case, the use of the solvent, BLO, at ~10% levels, offered improved metal safety.

Although the invention has been described in terms of particular embodiments, blends of one or more of the various additives described herein can be used, and substitutes therefore, as will be know to those skilled in the art. Thus the invention is not meant to be limited to the details described herein, but only by the scope of the appended claims.

What is claimed:

1. A metal-safe composition effective for dissolving a cured polysulfide resin comprising:

(a) a solvent mixture of aprotic solvents selected from the group consisting of n,n-dimethylacetamide, gamma-butyrolactone, n-methylpyrrolidone, n-ethylpyrrolidone, and n-butylpyrrolidone exhibiting a high penetration and solvency capacity for polar resins such as polysulfide; and, (b) a soluble alkali component exhibiting a high pKa value ≥12 and are bicycloorganic bases selected from a group consisting of 1,8-diazabicyclo[5.4.0]undec-7-ene (DABCO), 1,4-diazabicyclo[2.2.2]octane (DBU) and 2,3,4,6,7,8,9,10-Octahydropyrimido(1,2-a)azepine (also DBU) and are present at less than 8% weight concentration;

(c) an organosilicon corrosion inhibitor selected from a group consisting of organosilane and organosilicate and are present at less than 5% weight concentration.

2. The composition of claim 1 wherein (a) comprises a solvent shown to be metal safe by sandwich corrosion tests using methods that follow a modified ASTM F1110.

3. The composition of claim 2 wherein (b) the soluble alkali of pKa ≥12 is an organic or inorganic origin to include hydroxides, alkanolamines, alkoxides, or amines.

4. The composition of claim wherein (b) the soluble alkali of pKa ≥12 is 1,8-diazabicyclo(5.4.0)undec-7-ene (DBU).

5. The composition of claim 3, which includes a compatible surfactant.

6. The composition of claim 5, which includes a hydroxypropylcellulose.

7. The composition of claim 6, which includes an additional corrosion inhibitor.

8. The composition of claim 1 wherein the corrosion inhibitor organosilicon is an organosilane.

9. The composition of claim 2 wherein the metal safe solvent mixture comprises gamma-butyrolactone (GBL).

10. The composition of claim 9 wherein the solvent mixture comprises n,n-dimethylacetamide (DMAC).

11. The composition of claim 10, which includes a compatible surfactant.

12. The composition of claim 11, which includes a hydroxypropylcellulose.

13. The composition of claim 1 wherein the corrosion inhibitor organosilicon is an organosilicate.

* * * * *